US005988039A

United States Patent [19]

Denchfield et al.

[11] Patent Number: 5,988,039

[45] Date of Patent: Nov. 23, 1999

[54] WEAPON SIMULATOR

[75] Inventors: Clifford Denchfield, Ellington; Paul Gledhill, Knebworth, both of United Kingdom

[73] Assignee: Lockheed Martin Tactical Sytems U.K. Limited, Hertfordshire, United Kingdom

[21] Appl. No.: 08/930,114

[22] PCT Filed: May 8, 1996

[86] PCT No.: PCT/GB96/01090

§ 371 Date: Jun. 25, 1998

§ 102(e) Date: Jun. 25, 1998

[87] PCT Pub. No.: WO96/35919

PCT Pub. Date: Nov. 14, 1996

[30] Foreign Application Priority Data

May 10, 1995 [GB] United Kingdom ..... 9509490

[51] Int. Cl.[6] ..... F41A 33/00

[52] U.S. Cl. ..... 89/7; 89/1.2; 89/1.14

[58] Field of Search ..... 89/7, 1.14, 1.2, 89/31

[56] References Cited

U.S. PATENT DOCUMENTS

| | | | |
|---|---|---|---|
| 3,479,857 | 11/1969 | Bloxsom, Jr. et al. | 89/7 |
| 4,416,630 | 11/1983 | Hagen et al. | 42/1.05 |
| 4,662,844 | 5/1987 | Gallagher et al. | 89/7 |
| 4,732,085 | 3/1988 | Gershenson et al. | 102/334 |
| 5,180,878 | 1/1993 | Denchfield | 89/7 |
| 5,646,363 | 7/1997 | Denchfield | 89/7 |

FOREIGN PATENT DOCUMENTS

| | | | |
|---|---|---|---|
| 100408 | 4/1916 | United Kingdom | 89/7 |

*Primary Examiner*—Stephen M. Johnson
*Attorney, Agent, or Firm*—Townsend and Townsend and Crew LLP

[57] ABSTRACT

A collapsible diaphragm covers an exhaust port of a weapon simulator. The weapon simulator containing a combustion chamber with admitted fuel gas, an ignition assembly within the combustion chamber; and an exhaust port. The collapsible diaphragm holds or contains a powder that discharges to simulate smoke associated with the weapon simulator.

11 Claims, 4 Drawing Sheets

WEAPON SIMULATOR

TECHNICAL FIELD

The invention relates to a weapon simulator for use for example in gunnery or weapons training to simulate the sound of gunfire.

BACKGROUND ART

It is known to provide gunfire simulators which simulate the flash and noise of a gun being fired or the strike of an explosive projectile. At their simplest such gunfire simulators may be no more than blank cartridges which directly take the place of live ammunition. However for use in simulating the firing of battlefield weapons from small arms through missile launchers to heavy guns such as tank guns and field artillery it is known to provide pyrotechnic devices which are housed in a metal block which may, for example, hold 12,20 or 24 rounds and which is fixed to the exterior of the weapon platform close to the barrel of the weapon in question. Usually the weight of such devices is such that they cannot be fixed directly to the barrel of the weapon. Often the devices are sufficiently bulky to create an obstruction to the sight of the tank or gun crew. Since such devices are limited to a relatively small number of rounds, a lack of realism can result. Also the cost of the pyrotechnic devices, while being much less than that of live ammunition, is nevertheless appreciable.

Our U.K. patent GB-B-2250333 discloses a gunfire simulator intended to address these problems and comprising a combustion chamber, means for admitting fuel gas to the combustion chamber, a flap valve for admitting air to the combustion chamber, means to force ambient air into the combustion chamber through the flap valve, ignition means for igniting fuel gas in the combustion chamber to cause an explosion, an exhaust port in the combustion chamber and outlet valve means for closing the exhaust port and arranged to open rapidly and with audible results in response to explosive pressure rise within the combustion chamber. Outlet valve means comprising a frangible diaphragm is specifically disclosed.

In the gunfire simulator disclosed in U.K. patent GB-B-2250333, the diaphragm may be part of a web, tape or ribbon of the thin sheet extending across the exhaust port and which is movable to position a fresh section of the sheet to close the exhaust port between one explosion and the next, and the simulator comprises means for feeding a fresh section of the web to the exhaust port after each explosion, and an automatic breechblock mechanism for releasably clamping a fresh section of the sheet in position during each explosion.

It is an object of the invention to provide a novel gunfire simulator of the same general kind as is disclosed in our U.K. patent GB-B-2250333.

DISCLOSURE OF INVENTION

The invention provides a collapsible diaphragm to form an outlet valve means in a weapon simulator of the kind comprising. a combustion chamber, means for admitting fuel gas to the combustion chamber, ignition means for igniting fuel gas in the combustion chamber to cause an explosion, an exhaust port in the combustion chamber, outlet valve means for closing the exhaust port and arranged to open rapidly and with audible results in response to explosive pressure rise within the combustion chamber and breechblock means for holding the outlet valve means in position to close the exhaust port, characterised in that the diaphragm comprises a disc of dimensionally-stable sheet material having a peripheral portion adapted to be held by the breechblock means. The dimensionally stable material may be cardboard or plastics.

The collapsible diaphragm may be constructed such that in use it collapses, that is to say, it deforms due to pressure rise in the combustion chamber such that it is released intact by the breechblock mechanism, at least to the extent that no part of the diaphragm is retained by the breechblock mechanism after firing. In this case it is important that the material of the diaphragm is chosen to be dimensionally stable such that its deformation does not cause the diaphragm to stretch to any significant extent since this might hinder or prevent the intact release of the diaphragm.

In some cases, e.g. if it is desired to modify the level of sound generated by the simulator, it might be desirable to provide the diaphragm with a portion, preferably centrally disposed, of reduced thickness and which is frangible. Thus the diaphragm may comprise a main disc-like body adapted to be gripped by its periphery in the breechblock mechanism of the simulator, the main body being formed centrally with a circular aperture covered by a frangible membrane secured to the main body, e.g. by means of an adhesive. In this case the main body of the diaphragm can be released manually or automatically by the breechblock mechanism.

The diaphragm may carry a frangible or otherwise rupturable receptacle e.g. of thin plastics sheet or foil containing a powder intended to simulate smoke associated with gunfire, the receptacle being arranged to discharge the powder when the diaphragm collapses. We have found that finely divided magnesium carbonate powder is suitable for this purpose. The receptacle may be in the form of a thermoformed plastics dish or tray secured by its peripheral lip to the diaphragm e.g. by means of an adhesive, so that the diaphragm closes the receptacle.

An alternative form of smoke simulating diaphragm may comprise a pair of discs at least one of which is frangible connected at their edges to the opposed axial ends of an axially short annular, e.g. cylindrical body to form an enclosure for the smoke simulating powder.

BRIEF DESCRIPTION OF DRAWINGS

The invention is diagrammatically illustrated, by way of example in the accompanying drawings in which.

BEST MODE FOR CARRYING OUT THE INVENTION

Figure 1:
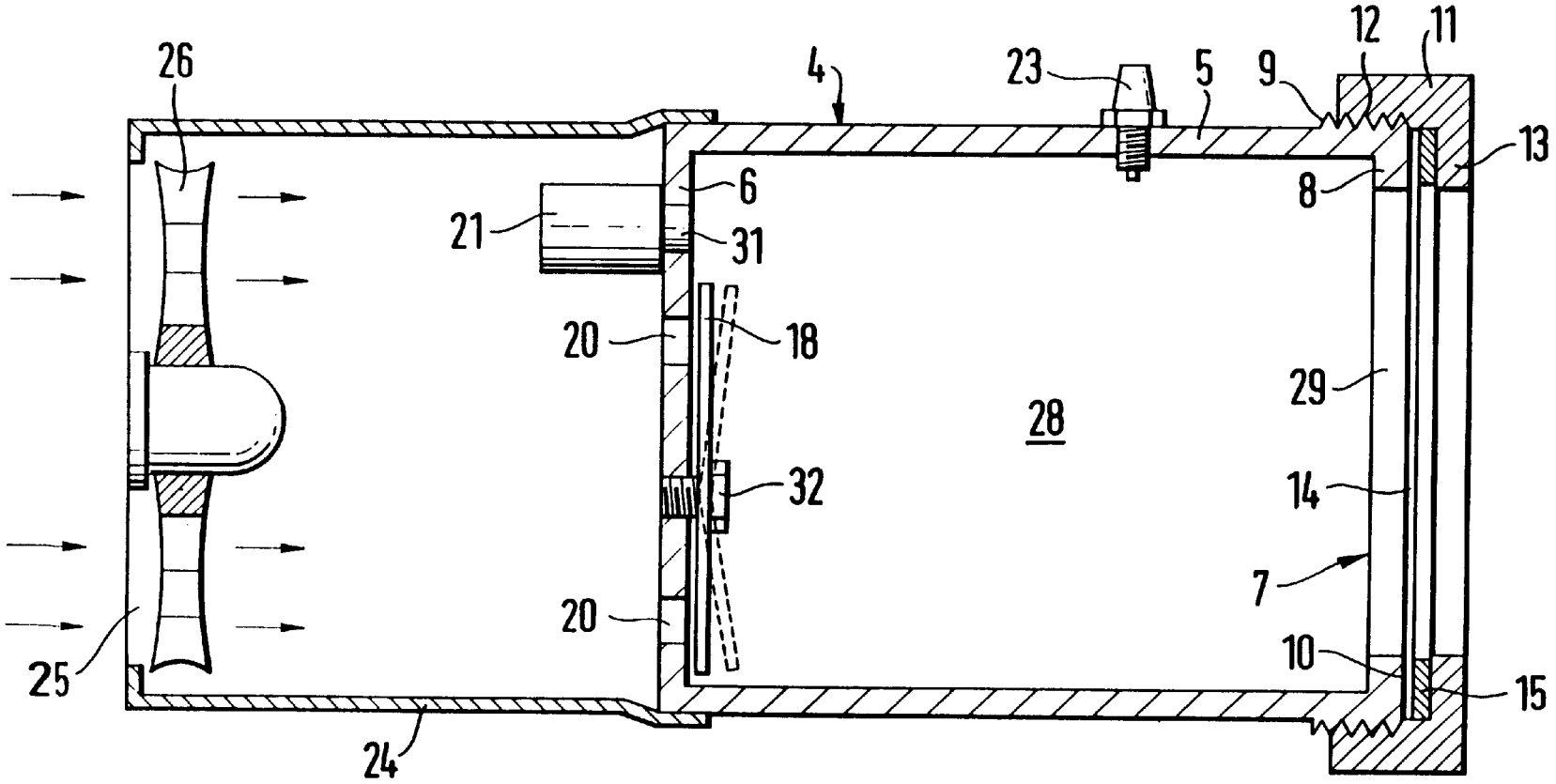
FIG. 1 is a cross-sectional side elevation of a single shot weapon simulator.

FIG. 1 of the drawings illustrates a single shot breechblock mechanism for a gunfire or weapon simulator generally of the kind described in our U.K. patent GB-B-2250333. In FIG. 1 a gunfire simulator 4 intended for use in battlefield weapons training comprises a generally cylindrical combustion chamber 28 defined by a cylindrical wall 5 bounded at one end by an end wall 6. The cylindrical wall 5 carries a spark plug 23 which projects into the chamber 28. Although not shown in the drawing, the electrodes of the spark plug preferably extend into the combustion chamber so that ignition occurs centrally. The end wall 6 carries a gas solenoid valve 21 which communicates with the interior of the chamber 28 through an inlet port 31. The end wall 6 is also formed with air inlet ports 20 which communicate between atmosphere and the chamber 28. The ports 20 are controlled by a flap valve 18 disposed within the chamber 28 adjacent to the end wall 6 and in the form of a resilient disc of a material such as synthetic rubber clamped to the wall 6 by fastening means 32 to close the ports 20 as shown in full lines, but capable of resilient deflection into the position shown in dotted lines to allow air into the combustion chamber.

The end 7 of the combustion chamber opposite to end wall 6 carries an inwardly projecting flange 8 which defines a circular aperture 29 which acts as an exhaust port communicating between the combustion chamber and atmosphere. The flange 8 also defines an axial end face 10. The end 7 of the combustion chamber is formed externally with screw threads 9. An annular member 11 is formed with internal screw threads 12 for mating engagement with the external screw threads 9 on the end 7 of the combustion chamber whereby the annular member 11 can be removably secured on the end of the combustion chamber to form a breechblock mechanism.

As an alternative to the screw-threaded engagement the annular member 11 may be releasably coupled to the end 7 of the combustion chamber by means of a bayonet coupling known per se. This will have the effect of providing positive stop means for preventing unintentional overtightening of the breechblock, which may occur with a screw-threaded breechblock.

The annular member 11 is formed at one end with an inwardly projecting flange 13 corresponding in diameter to that of the flange 8 of the combustion chamber. A disc-like collapsible diaphragm 14 described more fully below is shown releasably clamped between the end face 10 of the combustion chamber and the flange 13 of the annular member 11, with the interposition of a resilient ring 15 between the diaphragm 14 and the flange 13 of the annular member 11 for the purpose appearing below.

The end 6 of the combustion chamber is continued rearwardly by a generally cylindrical housing 24 formed with an open end 25 in which is mounted a fan or a blower 26 which is used to force air into the combustion chamber via the inlet ports 20.

In operation of the simulator device, fuel gas, e.g. a mixture of propane and butane, is admitted to the combustion chamber 28 through the gas valve 21 and combustion air is blown into the combustion chamber through the ports 20 by the fan 26, during which period the flap valve 18 deforms into the position shown in dotted lines. The fuel/air mixture is then ignited by means of the spark plug 23 so that pressure within the combustion chamber rises rapidly. This rise in pressure causes the inlet valve 18 to close, i.e. assume the position shown in full lines. When the pressure reaches a given level the diaphragm 14 will collapse and in collapsing will become detached from the breechblock to allow the combustion gases to escape through the exhaust port 29 thus causing the characteristic flash and bang of a fired weapon or explosive strike. The diaphragm, which acts as an exhaust valve, releases as quickly as possible to give a sharp report. The fan or blower 26 preferably operates continuously so that when the pressure in the chamber 28 drops, the inlet valve 18 opens so that air is admitted to the combustion chamber to purge the exhaust gases via the open exhaust port.

As indicated above, the annular ring member 11 and the end 10 of the combustion chamber together form a breechblock mechanism for releasably clamping the disc-like diaphragm 14, which forms outlet valve means to close the combustion chamber. This is achieved by resiliently clamping the peripheral edge of the diaphragm 14 between the opposed pair of flanges 8 and 13 with the interposition of the elastic ring 15 so that the diaphragm is expelled intact from the combustion chamber when an adequate pressure rise takes place, caused by the explosive combustion of a fuel/air mixture. In a preferred implementation, the elastic ring 15 is of neoprene rubber and the threaded clamp ring 11 is tightened against a mechanical stop to control the compression force on the elastic ring 15. When explosive combustion takes place in the chamber, the sudden rise in internal pressure causes the diaphragm to deform sufficiently to be released by the clamping mechanism formed by the threaded ring, the elastic ring 15 and the rim 10 of the combustion chamber, so that the diaphragm is expelled from the combustion device intact and in doing so generates the desired noise effect.

Figure 2:
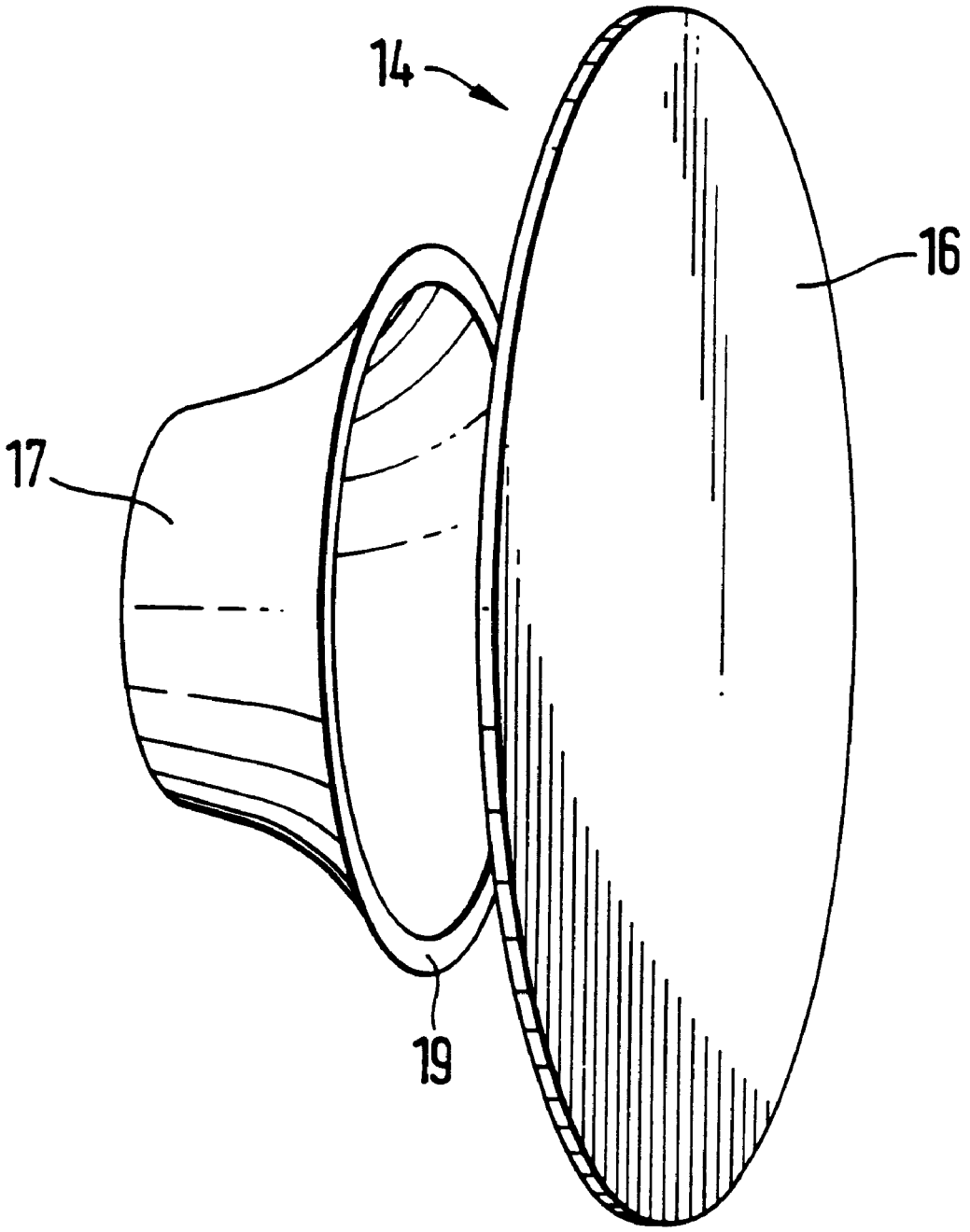
FIG. 2 is an exploded perspective view of an embodiment of diaphragm for a weapon simulator of the kind shown in FIG. 1, and incorporating smoke simulating means.

As shown in FIG. 2, a diaphragm 14, suitable for the breech block mechanism of FIG. 1 is formed by a single disc 16 of a material such as paper, plastics or card. The volume of the generated sound, and its acoustic spectrum, are variable by modification of the diaphragm geometry and materials and by variation of the diaphragm deforming pressure wave characteristics. Furthermore, the diaphragm may be treated to be proof against moisture or to biodegrade in a controlled manner. Thus the diaphragm may be coated e.g. with varnish.

FIG. 2 also illustrates a means for the production of a smoke effect, conventionally produced by pyrotechnic means and used in conjunction with weapon firing and hit simulation. The means comprises a rupturable dish-like container 17, e.g. of frangible thin plastics sheet sealed by its peripheral edge 19 to the center of the diaphragm 16 e.g. with the aid of an adhesive and containing the material which is to form the simulated smoke cloud, e.g. magnesium carbonate powder. In use the diaphragm 14 is positioned in the breechblock such that the container 17 is disposed within the combustion chamber 28.

When the diaphragm 14 is expelled from the simulator the container is ruptured, or at least is detached from the disc 16, to discharge the smoke material forth to create the effect of a smoke cloud. The volume, density and colour of the simulated smoke cloud are all variable by modification of the smoke material, the geometry of the diaphragm 14 and the rupturing pressure wave characteristics of the simulator.

Figure 3:
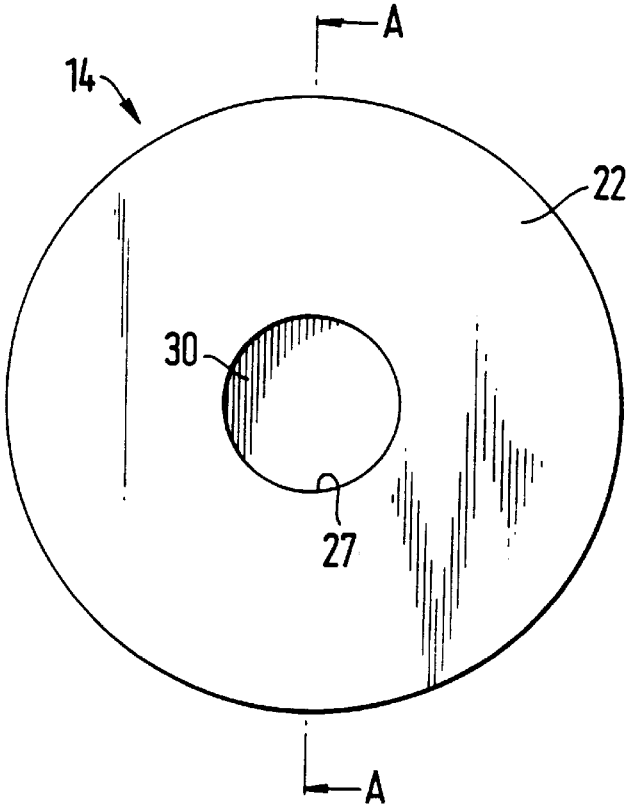
FIG. 3 is a plan of a further embodiment of diaphragm.
Figure 4:
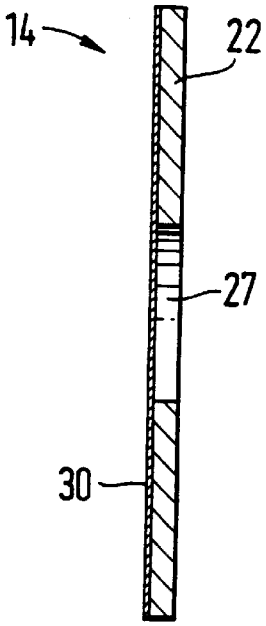
FIG. 4 is a cross-section, to an enlarged scale, on the line of A—A of FIG. 3.

In FIGS. 3 and 4 there is shown a diaphragm 14 generally as shown in FIG. 2 and comprising a main body or carrier disc 22 with central circular aperture or hole 27 with a thinner, bursting or frangible disc 30 bonded e.g. with heat sensitive adhesive to one face thereof. The external face of the diaphragm 14 is preferably varnished to proof the diaphragm against moisture and also to provide a visual indication of the correct installation attitude of the diaphragm in the breechblock.

The carrier disc may be made from $0.58_{mm}$ thick Grade K Tan shade calendered pressboard varnished with red dye on one face, to provide a visual indicator and coated with a heat sensitive adhesive on the other face. The bursting disc may be made from $0.1_{mm}$ thick Elephantide electrical presspaper Grade K buff varnished on its exposed face.

Thus in operation the bursting disc is fractured due to pressure rise in the combustion chamber of the simulator to cause an explosion. The remainder of the diaphragm can then be released from the breechblock either manually or automatically.

Figure 5:
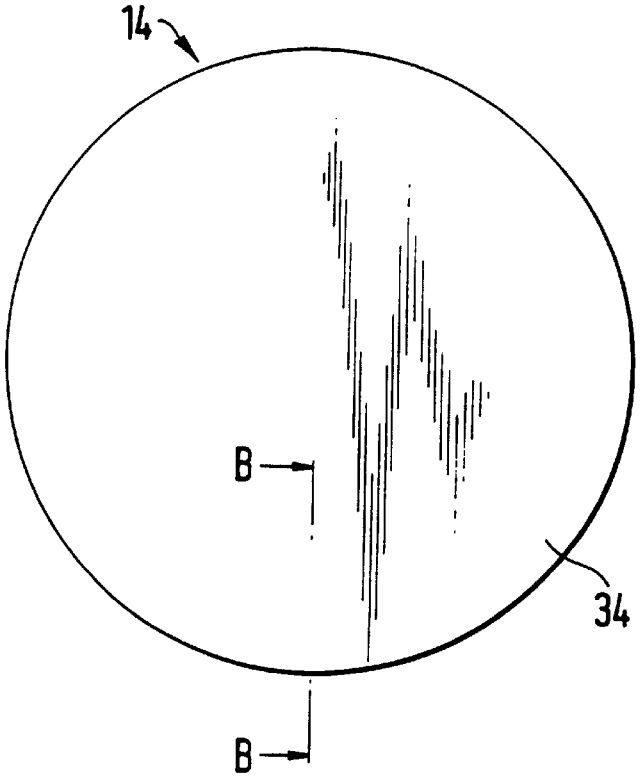
FIG. 5 is a plan view of another embodiment of smoke simulating diaphragm.
Figure 6:
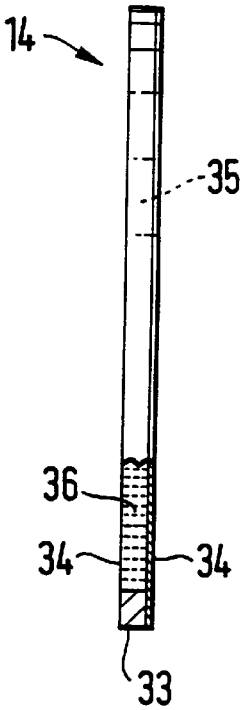
FIG. 6 is a partly sectioned side view of the diaphragm shown in FIG. 5 taken on the line B—B of FIG. 5.

In FIGS. 5 and 6 there is shown a further embodiment of smoke simulating diaphragm 14 intended to operate in a generally simular manner to that of FIG. 2. The construction consists of a cardboard cylindrical annulus 33 having an axial length of 4 to $5_{mm}$ varnished on its exterior surface and sandwiched between two $0.58_{mm}$ thick frangible discs 34 of Grade K tan shade calendered pressboard. The internal surfaces may be coated with a heat sensitive adhesive and the external surfaces may be coated with red dyed varnish, in the interests of visibility. The cavity 35 formed by the sandwich construction can be partly filled with magnesium carbonate/oxide powder 36 e.g. 3 g.

The advantage of this embodiment of smoke diaphragm is the possibility of improved smoke simulation and also to permit an easily/speedily loadable diaphragm for multi-shot gunfire simulators, although it is envisaged that it could also be used for the single shot breech mechanism of FIG. 1.

INDUSTRIAL APPLICABILITY

The invention thus provides a novel weapon simulator.

We claim:

1. A collapsible diaphragm which is adapted to be used in a weapon simulator comprising a combustion chamber, means for admitting fuel gas to the combustion chamber, ignition means for igniting the fuel gas in the combustion chamber to cause an explosion, an exhaust port in the combustion chamber, and a breechblock mechanism, wherein the diaphragm comprises a disc of dimensionally-stable sheet material having a peripheral portion which is adapted to be held by the breechblock mechanism so as to close the exhaust port, wherein the disc is capable of producing audible results in response to an explosive pressure rise within the combustion chamber, and wherein the disc includes a receptacle containing a powder to simulate smoke associated with weaponry, the receptacle being adapted to discharge the powder when the diaphragm collapses.

2. A collapsible diaphragm according to claim 1, wherein the dimensionally stable material is cardboard or plastics.

3. A collapsible diaphragm according to claim 1, wherein the diaphragm further comprises a frangible portion of reduced thickness.

4. A collapsible diaphragm according to claim 3, wherein the frangible portion is disposed centrally of the diaphragm.

5. A collapsible diaphragm according to claim 1, wherein the disc includes a main disc portion formed centrally with an aperture and a frangible disc portion secured to the main disc portion to cover the aperture such that the part of the frangible disc portion covering the aperture is frangible.

6. A collapsible diaphragm according to claim 1, wherein the powder is finely divided magnesium carbonate.

7. A collapsible diaphragm according to claim 1, wherein the receptacle comprises a dish formed from sheet material sealed to the disc whereby the disc closes the receptacle.

8. A collapsible diaphragm according to claim 1, wherein the disc comprises a cylindrical body having opposing axial ends and a spaced pair of end members, at least one of which is frangible, wherein the end members have edges which are connected to the axial ends of the cylindrical body to form the receptacle.

9. A collapsible diaphragm which is adapted to be used in a weapon simulator comprising a combustion chamber, means for admitting fuel gas to the combustion chamber, ignition means for igniting the fuel gas in the combustion chamber to cause an explosion, an exhaust port in the combustion chamber, and a breechblock mechanism, wherein the diaphragm comprises a main disc portion of dimensionally-stable sheet material formed centrally with an aperture and having a peripheral portion which is adapted to be held by the breechblock mechanism so as to close the exhaust port, and a frangible portion secured to the main disc portion to cover the aperture such that the part of the frangible disc portion covering the aperture is frangible, wherein the diaphragm is capable of producing audible results in response to an explosive pressure rise within the combustion chamber, and wherein the diaphragm includes a receptacle containing a powder to simulate smoke associated with weaponry, the receptacle being adapted to discharge the powder when the diaphragm collapses.

10. A collapsible diaphragm which is adapted to be used in a weapon simulator comprising a combustion chamber, means for admitting fuel gas to the combustion chamber, ignition means for igniting the fuel gas in the combustion chamber to cause an explosion, an exhaust port in the combustion chamber, and a breechblock mechanism, wherein the diaphragm comprises a disc of dimensionally-stabre sheet material having a peripheral portion which is adapted to be held by the breechblock mechanism so as to close the exhaust port, wherein the diaphragm is capable of producing audible results in response to an explosive pressure rise within the combustion chamber, wherein the diaphragm further comprises a receptacle containing a powder to simulate smoke associated with weaponry, the receptacle comprising a dish formed from sheet material sealed to the disc such that the disc closes the receptacle, and wherein the receptacle is adapted to discharge the powder when the diaphragm collapses.

11. A collapsible diaphragm which is adapted to be used in a weapon simulator comprising a combustion chamber, means for admitting fuel gas to the combustion chamber, ignition means for igniting the fuel gas in the combustion chamber to cause an explosion, an exhaust port in the combustion chamber, and a breechblock mechanism, wherein the diaphragm comprises an annular body having opposed axial ends, a spaced pair of discs at least one of which is frangible and both of which are connected at their edges to the opposed axial ends of the annular body, the diaphragm having a peripheral portion which is adapted to be held by the breechblock mechanism so as to close the exhaust port, wherein the diaphragm is capable of producing audible results in response to an explosive pressure rise within the combustion chamber, wherein the diaphragm further comprises a receptacle defined between the pair of discs and the annular body and containing a powder to simulate smoke associated with weaponry, the receptacle being adapted to discharge the powder when the diaphragm collapses.

* * * * *